US009673008B2

(12) United States Patent
Tachikawa et al.

(10) Patent No.: US 9,673,008 B2
(45) Date of Patent: Jun. 6, 2017

(54) ELECTROMAGNETIC SWITCH

(71) Applicants: FUJI ELECTRIC CO., LTD., Kawasaki-shi (JP); FUJI ELECTRIC FA COMPONENTS & SYSTEMS CO., LTD., Chuo-ku, Tokyo (JP)

(72) Inventors: Hiroyuki Tachikawa, Yokohama (JP); Masaru Isozaki, Ichihara (JP); Osamu Kashimura, Hino (JP); Kouetsu Takaya, Kounosu (JP)

(73) Assignees: FUJI ELECTRIC CO., LTD., Kawasaki-shi (JP); FUJI ELECTRIC FA COMPONENTS & SYSTEMS CO., LTD., Tokyo (JP)

( * ) Notice: Subject to any disclaimer, the term of this patent is extended or adjusted under 35 U.S.C. 154(b) by 70 days.

(21) Appl. No.: 14/505,616

(22) Filed: Oct. 3, 2014

(65) Prior Publication Data

US 2015/0015350 A1 Jan. 15, 2015

Related U.S. Application Data

(63) Continuation of application No. PCT/JP2013/002476, filed on Apr. 11, 2013.

(30) Foreign Application Priority Data

Apr. 27, 2012 (JP) ..... 2012-103972

(51) Int. Cl.
*H01H 50/18* (2006.01)
*H01H 1/66* (2006.01)
(Continued)

(52) U.S. Cl.
CPC ..... *H01H 50/18* (2013.01); *H01H 1/66* (2013.01); *H01H 50/02* (2013.01); *H01H 50/54* (2013.01);
(Continued)

(58) Field of Classification Search
CPC ..... H01H 1/66; H01H 50/54; H01H 50/546; H01H 50/18; H01H 50/541; H01H 50/02; H01H 2050/025
See application file for complete search history.

(56) References Cited

U.S. PATENT DOCUMENTS 3,102,935 A * 9/1963 Christeler ..... H01H 1/20 335/131
3,727,157 A * 4/1973 Grunert ..... H01H 50/22 200/294
(Continued)

FOREIGN PATENT DOCUMENTS

CN 102194610 A 9/2011
DE 102010032456 A1 2/2012
(Continued)

OTHER PUBLICATIONS

PCT, "International Search Report for International Application No. PCT/JP2013/002476".
(Continued)

*Primary Examiner* — Bernard Rojas
(74) *Attorney, Agent, or Firm* — Manabu Kanesaka

(57) ABSTRACT

An electromagnetic switch includes a contact housing case; a plurality of contact mechanisms each having a fixed contact and a movable contact contacting to and separating from the fixed contact, and disposed in parallel inside the contact housing case; a movable contact holding portion holding the movable contacts of the plurality of contact mechanisms; and an electromagnet unit having a movable plunger moving the movable contact holding portion.

7 Claims, 12 Drawing Sheets

(51) Int. Cl.

| | |
|---|---|
| ***H01H 50/54*** | (2006.01) |
| ***H01H 50/56*** | (2006.01) |
| ***H01H 50/58*** | (2006.01) |
| ***H01H 50/64*** | (2006.01) |
| *H01H 50/02* | (2006.01) |

(52) U.S. Cl.

CPC ..... *H01H 50/541* (2013.01); *H01H 50/56* (2013.01); *H01H 50/58* (2013.01); *H01H 50/641* (2013.01); *H01H 50/546* (2013.01); *H01H 2050/025* (2013.01)

(56) References Cited

U.S. PATENT DOCUMENTS

| | | | | |
|---|---|---|---|---|
| 3,942,143 | A * | 3/1976 | Pollmann | H01H 50/541 335/132 |
| 7,889,032 | B2 * | 2/2011 | Parker | H01H 51/2227 335/128 |
| 7,944,333 | B2 | 5/2011 | Swartzentruber et al. | |
| 8,274,347 | B2 | 9/2012 | Eum | |
| 9,312,087 | B2 * | 4/2016 | Yeon | H01H 50/02 |
| 2009/0243769 | A1 | 10/2009 | Takaya et al. | |
| 2013/0181793 | A1 | 7/2013 | Bauer et al. | |

FOREIGN PATENT DOCUMENTS

| | | | |
|---|---|---|---|
| JP | S48-44785 | B1 | 12/1973 |
| JP | S61-60430 | U | 4/1986 |
| JP | 2010-073352 | A | 4/2010 |
| JP | 2010-73352 | A | 4/2010 |

OTHER PUBLICATIONS

Europe Patent Office, "Search Report for European Patent Application No. 13782030.4," Jun. 27, 2016.

China Patent Office, "Office Action for Chinese Patent Application No. 201380018877.7," Jun. 2, 2016.

* cited by examiner

ELECTROMAGNETIC SWITCH

CROSS-REFERENCE TO RELATED APPLICATION

The present application is a continuation application of PCT International Application No. PCT/JP2013/002476 filed Apr. 11, 2013, and claims priority from Japanese Application No. 2012-103972 filed Apr. 27, 2012.

TECHNICAL FIELD

The present invention relates to an electromagnetic switch wherein a plurality of contact mechanisms including a main contact mechanism having at least a pair of fixed contacts and a movable contact is disposed in parallel inside a contact housing case, and the movable contacts of the plurality of contact mechanisms are caused to move by an electromagnet unit.

BACKGROUND ART

Sometimes, a main contact mechanism that allows a large current to pass and interrupt, and an auxiliary contact mechanism linked to the operation of the main contact mechanism, are provided in an electromagnetic switch such as an electromagnetic relay or electromagnetic contactor. An electromagnetic switch described in, for example, PTL 1 is known for providing a main contact mechanism and auxiliary contact mechanism in this way.

The electromagnetic switch described in PTL 1 is such that a movable contact coupled by a coupling shaft to a movable plunger of an electromagnet unit is disposed between a pair of fixed contacts so as to be capable of contacting to and separating from the pair of fixed contacts. Further, an auxiliary contact terminal pusher is disposed to face the leading end of the coupling shaft protruding beyond the movable contact, and an auxiliary contact movable terminal is pressed by the auxiliary contact terminal pusher. The auxiliary contact movable terminal is such that the auxiliary contact is in an off-state in a condition wherein the auxiliary contact terminal pusher is not being pressed by the coupling shaft, while the auxiliary contact is in an on-state in a condition wherein the auxiliary contact terminal pusher is being pressed by the coupling shaft.

CITATION LIST

Patent Literature

PTL 1: U.S. Pat. No. 7,944,333

SUMMARY OF INVENTION

Technical Problem

However, the heretofore known example described in PTL 1 is such that auxiliary contact mechanisms are disposed in a serial state in the vicinity of the fixed terminals of the main contact mechanism. Because of this, although it is possible to drive the main contact mechanism and auxiliary contact mechanisms with the electromagnet unit, there is an unresolved problem in that, when a plurality of main contact mechanisms is provided, it is necessary to provide a plurality of contacts.

Also, in the auxiliary contact mechanism, in order to obtain isolation from the main contact mechanism, the contact size, number of contacts, and contact configuration are limited, and there is an unresolved problem in that the interruption limit value of the auxiliary contact mechanism is small, and contact lifespan is short.

Furthermore, there is also an unresolved problem in that the movable contact of the auxiliary contact mechanism is of a cantilever spring structure with low rigidity, there is considerable variation in gap dimension, and it is difficult to obtain mirror contact with the main contact mechanism. Furthermore, there is also an unresolved problem in that contact configuration is limited, and it is therefore not possible to meet the demands of various customers.

Therefore, the invention, having been contrived focusing on the unresolved problems of the heretofore known example, has an object of providing an electromagnetic switch such that a plurality of contact mechanisms is disposed in parallel, there is considerable freedom of contact configuration, and it is possible to reliably obtain mirror contact of each of the plurality of contact mechanisms.

Solution to Problem

In order to achieve the heretofore described object, a first aspect of an electromagnetic switch according to the invention is such that a plurality of contact mechanisms each having at least a fixed contact and a movable contact disposed so as to be capable of contacting to and separating from the fixed contact is disposed in parallel inside a contact housing case. Further, the electromagnetic switch includes a movable contact holding portion holding the movable contacts of the plurality of contact mechanisms, and an electromagnet unit having a movable plunger that moves the movable contact holding portion.

According to the first aspect, by disposing a plurality of contact mechanisms in parallel inside a contact housing case, and holding the movable contact of each contact mechanism in a movable contact holding portion, it is possible to cause the plurality of movable contacts to move using the movable plunger of the same electromagnet unit, while maintaining mirror contact.

Also, a second aspect of the electromagnetic switch according to the invention is such that the plurality of contact mechanisms includes at least one set of main contact mechanisms including a pair of fixed contacts disposed to maintain a predetermined interval and a movable contact disposed so as to be capable of contacting to and separating from the pair of fixed contacts.

According to the second aspect, at least one contact mechanism among the plurality of contact mechanisms disposed in parallel inside the contact housing case is adopted as a main contact mechanism. Because of this structure, it is possible to provide a set of two main contact mechanisms, or a main contact mechanism and auxiliary contact mechanism, inside the contact housing case.

Also, a third aspect of the electromagnetic switch according to the invention is such that the plurality of contact mechanisms includes an auxiliary contact mechanism including a pair of fixed contacts disposed to maintain a predetermined interval and a movable contact disposed so as to be capable of contacting to and separating from the pair of fixed contacts.

According to the third aspect, it is possible to drive the main contact mechanism and auxiliary contact mechanism simultaneously with the movable element of the same electromagnet unit.

Also, a fourth aspect of the electromagnetic switch according to the invention is such that the plurality of contact mechanisms includes a set of two auxiliary contact mechanisms.

According to the fourth aspect, as it is possible to provide a set of two auxiliary contact mechanisms, it is possible to configure the auxiliary contact mechanism contact configuration using various specifications.

Also, a fifth aspect of the electromagnetic switch according to the invention is such that the contact housing case has an isolating partition portion that partitions a housing section housing the main contact mechanisms.

According to the fifth aspect, as the main contact mechanisms are separated by the isolating partition portion, it is possible to prevent interference with another contact mechanism.

Advantageous Effects of Invention

According to the invention, a plurality of contact mechanisms is disposed in parallel inside a contact housing case, the movable contact of each contact mechanism is held in the same movable contact holding portion, and the movable contact holding portion is driven by the movable plunger of the same electromagnet unit. Because of this, it is possible to obtain mirror contact of the plurality of contact mechanisms. It is possible to dispose a set of two main contact mechanisms inside the contact housing case, and thus possible to reduce the size of the overall configuration.

Also, by adopting a contact mechanism other than the main contact mechanism as an auxiliary contact mechanism, it is possible to increase the freedom of the auxiliary contact mechanism contact configuration.

DESCRIPTION OF EMBODIMENTS

Hereafter, based on the drawings, a description will be given of embodiments of the invention.

Figure 1:
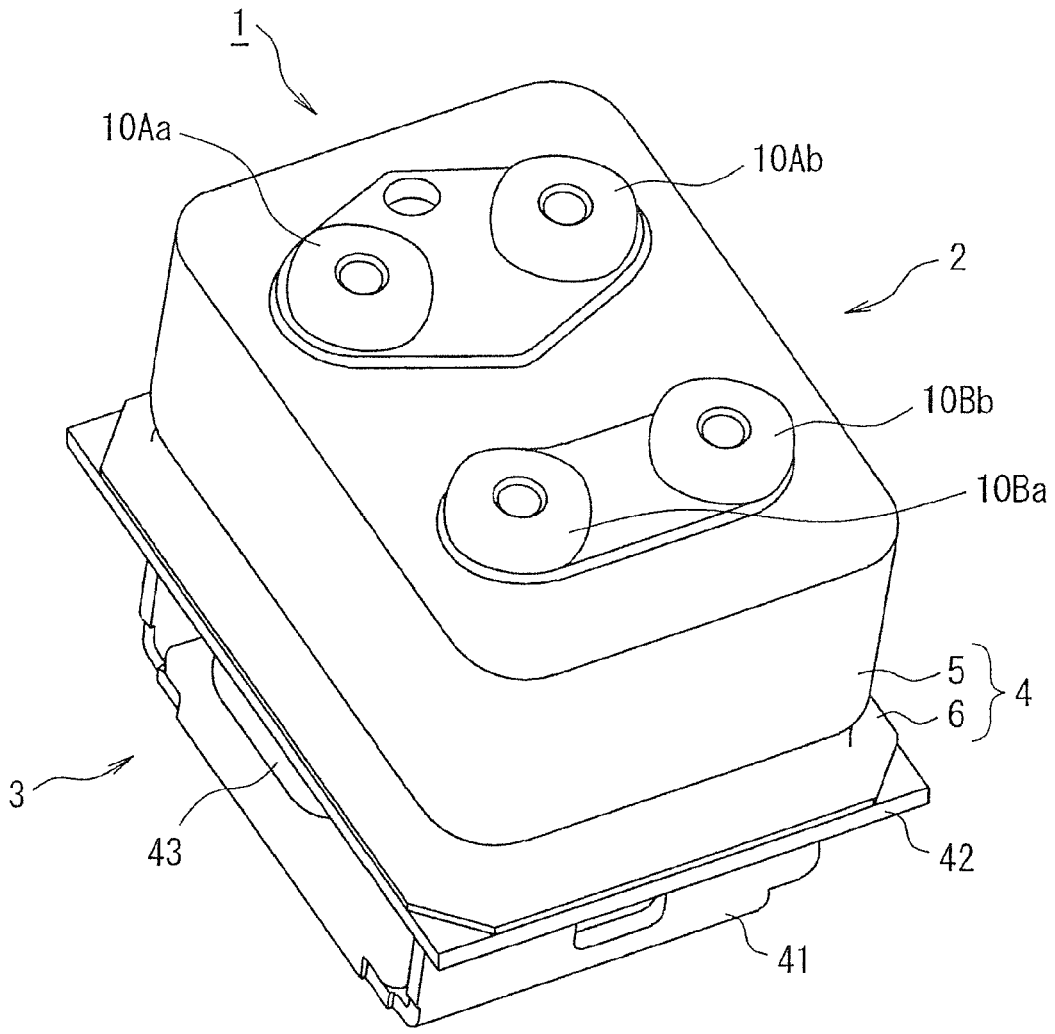
FIG. 1 is an external perspective view showing a first embodiment of a case wherein the invention is applied to an electromagnetic contactor.
Figure 2:
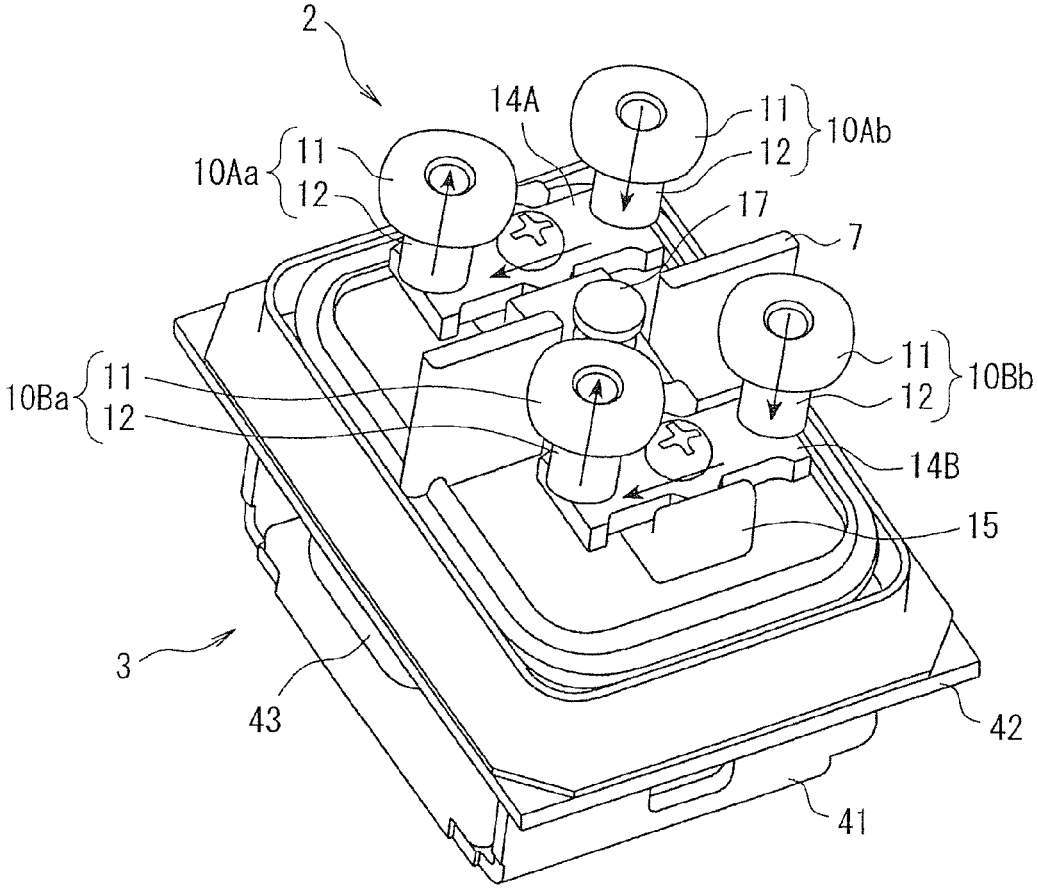
FIG. 2 is a perspective view of a state wherein a contact housing case of FIG. 1 has been removed.

FIG. 1 is an external perspective view showing an example of a case wherein an electromagnetic contactor is applied as an electromagnetic switch of the invention. FIG. 2 is a perspective view of a state wherein a contact housing case of FIG. 1 has been removed.

In FIG. 1, reference 1 is an electromagnetic contactor. The electromagnetic contactor 1 is such that a contact device 2 in which are disposed contact mechanisms and an electromagnet unit 3 that drives the contact device 2 is disposed in series in a vertical direction with the electromagnet unit 3 on the lower side.

The contact device 2 has a contact housing case 4, wherein the contact housing case 4 is configured of a bottomed cylindrical tub-form body 5 formed of a ceramic, the lower end of which is opened, and a metal joining member 6 fixed in a hermetic state to the opened end surface of the tub-form body 5. Further, the joining member 6 is fixed in a hermetic state by brazing, welding, or the like, to the upper surface of an upper magnetic yoke 42, to be described hereafter, of the electromagnet unit 3.

Figure 5:
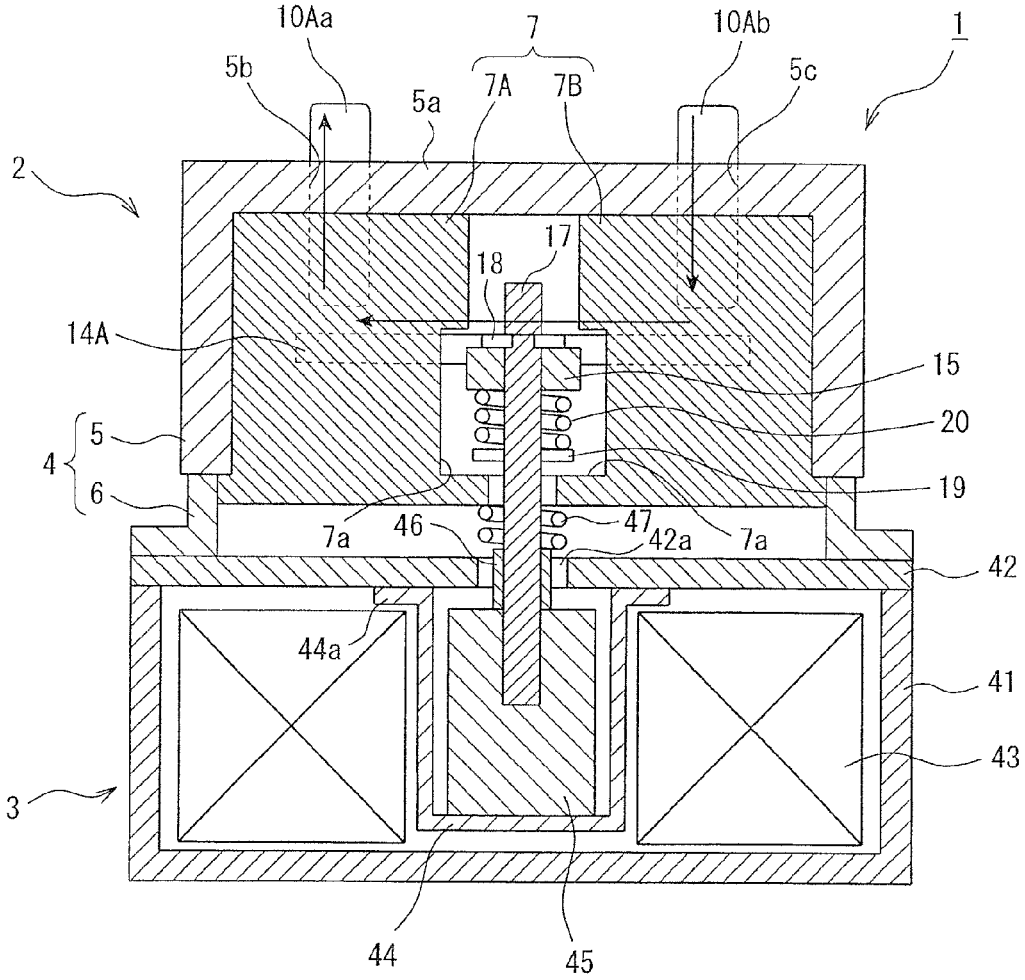
FIG. 5 is a sectional view along the line B-B of FIG. 4.
Figure 6:
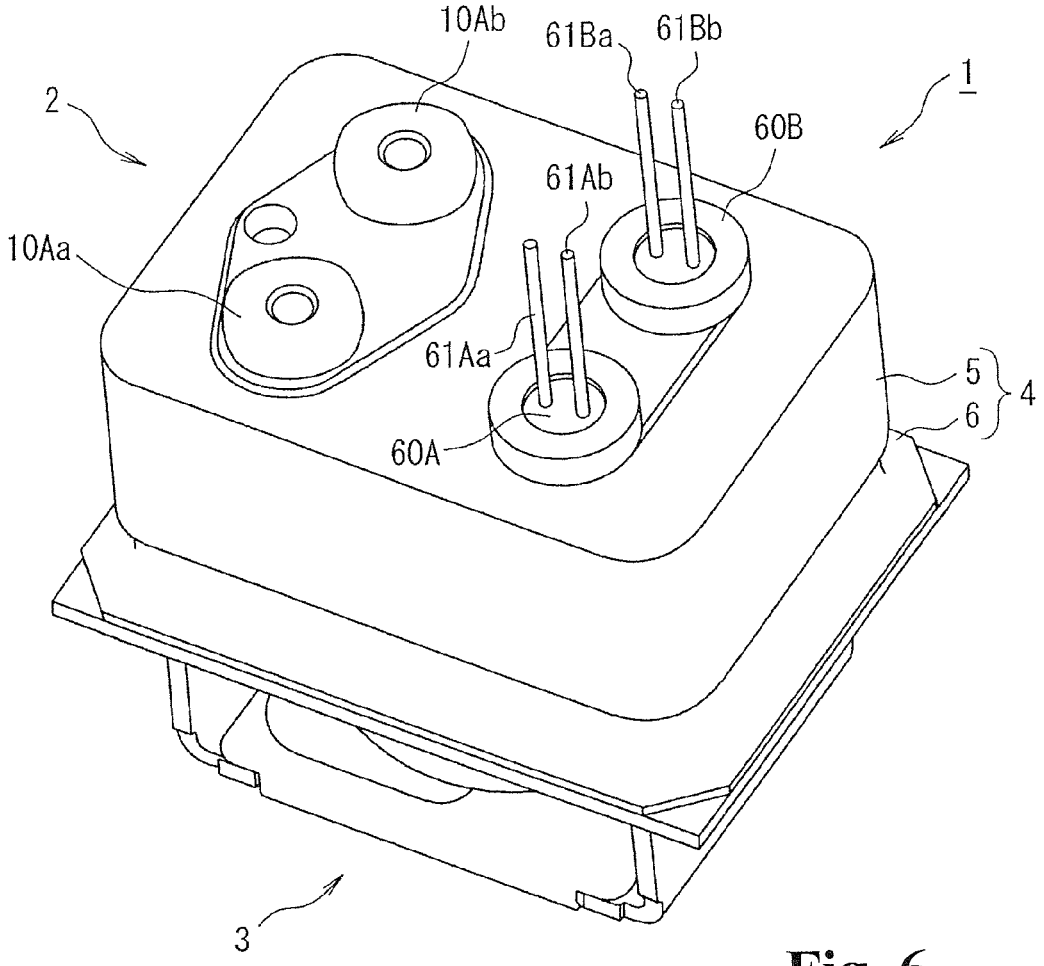
FIG. 6 is an external perspective view showing a second embodiment of the invention.
Figure 7:
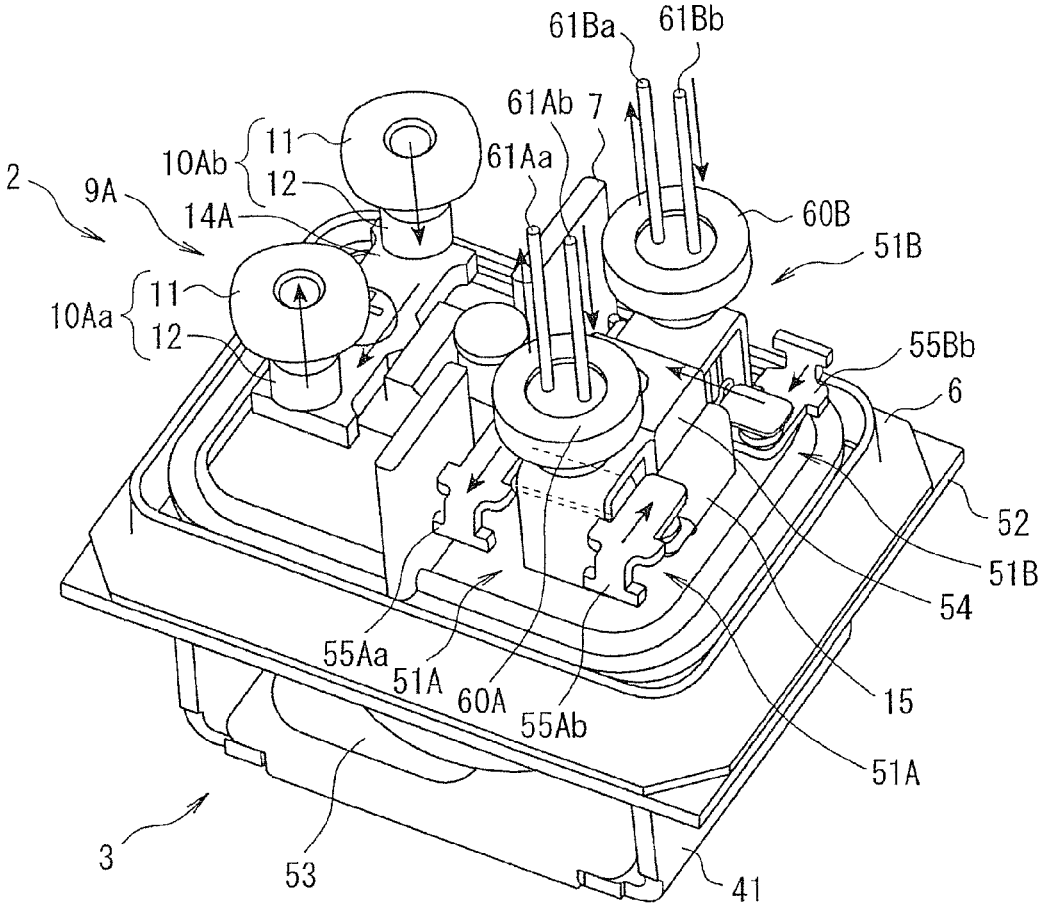
FIG. 7 is a perspective view of a state wherein a contact housing case of FIG. 6 has been removed.

The contact housing case 4, as shown in FIG. 2 and FIG. 5, is divided horizontally by an isolating partition portion 7 with insulating properties in a horizontal direction central portion inside the tub-form body 5, whereby contact housing chambers 8A and 8B are formed. The isolating partition portion 7 is configured of dividing bodies 7A and 7B divided into front and back in a central portion, as shown in FIG. 5. Cutaway portions 7*a* that allow movement of a movable contact holding portion 15, coupling shaft 17, retaining rings 18 and 19, and a contact spring 20, to be described hereafter, are formed in center side end portions in the dividing bodies 7A and 7B.

Figure 3:
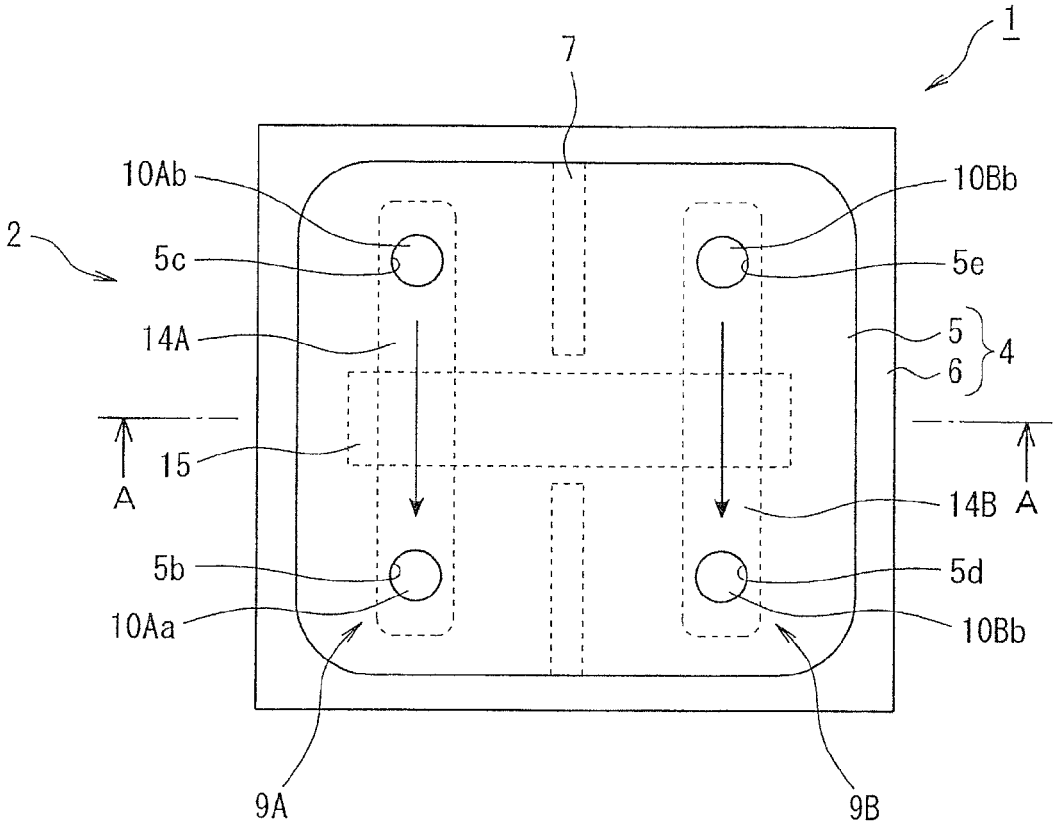
FIG. 3 is a plan view of FIG. 1.

Main contact mechanisms 9A and 9B are housed one each in the left and right contact housing chambers 8A and 8B. The main contact mechanisms 9A and 9B have pairs of fixed contacts 10Aa, 10Ab and 10Ba, 10Bb fixed in a hermetic state by brazing, welding, or the like, in insertion holes 5*b*, 5*c* and 5*d*, 5*e* disposed maintaining predetermined intervals in a front-back direction in an upper surface plate 5*a* of the tub-form body 5, as shown in FIG. 2, FIG. 3, and FIG. 5.

Each of the fixed contacts 10Aa, 10Ab and 10Ba, 10Bb is configured of a large diameter portion 11 contacting the upper surface of the upper surface plate 5*a* of the tub-form body 5 and a small diameter portion 12 extending from the lower surface of the large diameter portion 11 into the contact housing chambers 8A and 8B through the insertion holes 5*b*, 5*c* and 5*d*, 5*e*.

Also, the main contact mechanisms 9A and 9B have movable contacts 14A and 14B, as shown in FIG. 2 and FIG. 5. The movable contacts 14A and 14B face the lower surfaces of the small diameter portions 12 of the fixed contacts 10Aa, 10Ab and 10Ba, 10Bb, maintaining a predetermined gap, and are disposed so as to be capable of contacting to and separating from the fixed contacts 10Aa, 10Ab and 10Ba, 10Bb.

The movable contacts 14A and 14B are fixed and held in the movable contact holding portion 15, which is disposed extending in a horizontal direction in a front-back direction central portion inside the contact housing case 4. Depressed grooves 16 extending in a front-back direction are formed in left and right end portion sides in the upper surface of the movable contact holding portion 15, and the movable contacts 14A and 14B are fitted into and held in the depressed grooves 16.

Further, the movable contact holding portion 15 is such that a horizontal direction central portion thereof is mounted on the coupling shaft 17, which is fixed to a movable plunger 45, to be described hereafter, of the electromagnet unit 3. That is, the movable contact holding portion 15 is such that upward movement thereof is regulated by the retaining ring 18, which is configured of a C-ring or E-ring fixed to the coupling shaft 17. Also, the lower end surface of the movable contact holding portion 15 is pressed upward by the contact spring 20, which is interposed between the lower end surface and the retaining ring 19, which is configured of a C-ring or E-ring fixed to the coupling shaft 17.

Also, the downward facing opened end surface of the tub-form body 5 is closed off by an isolating plate 21. An insertion hole 21*a* through which the coupling shaft 17 is inserted is formed in a central portion of the isolating plate 21.

Figure 4:
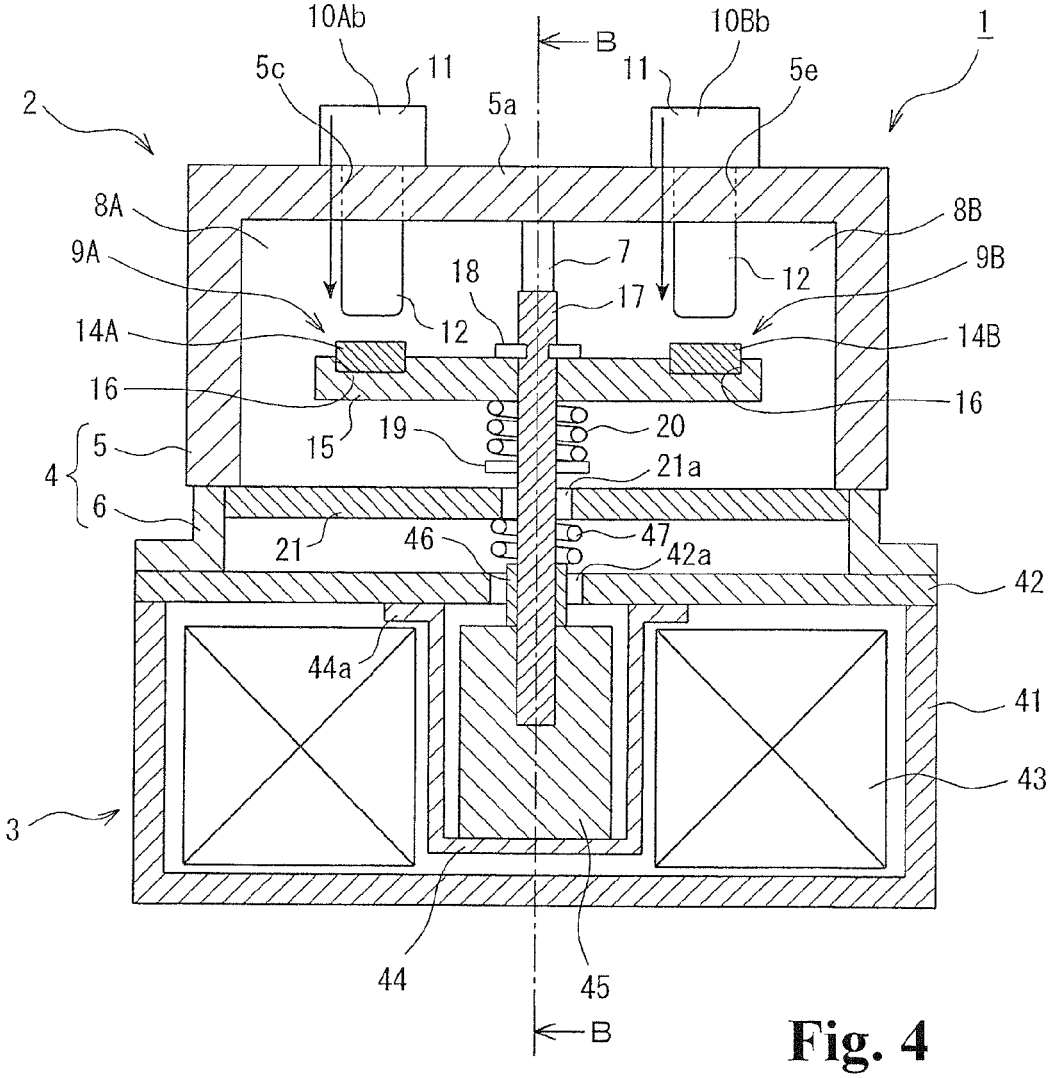
FIG. 4 is a sectional view along the line A-A of FIG. 3.

Meanwhile, the electromagnet unit 3 has a magnetic yoke 41 of a flattened U-form, and a rectangular plate form upper magnetic yoke 42 bridging the opened end side of the magnetic yoke 41, as shown in FIG. 4.

A cylindrical exciting coil 43 is disposed in the interior of the magnetic yoke 41, and a cap 44 formed in a bottomed cylindrical body form of a non-magnetic metal is disposed on the inner peripheral surface of the exciting coil 43.

A flange portion 44*a* extending outward is formed on the upper end of the cap 44, and the flange portion 44*a* is fixed in a hermetic state to the lower surface of the upper magnetic yoke 42 by brazing, welding, or the like.

The columnar movable plunger 45 is disposed so as to be movable in a vertical direction in the interior of the cap 44, and the coupling shaft 17 is fitted into, and fixed in, an upper central position of the movable plunger 45. Also, a cylindrical body 46 is fixed around the coupling shaft 17 on the upper surface of the movable plunger 45. The cylindrical body 46 extends slightly to the upper surface side of the upper magnetic yoke 42 through an insertion hole 42*a* formed in a central portion of the upper magnetic yoke 42. Further, a return spring 47 is interposed between the upper surface of the cylindrical body 46 and the isolating plate 21 around the coupling shaft 17.

Also, an arc extinguishing gas such as hydrogen gas, nitrogen gas, a mixed gas of hydrogen and nitrogen, air, or $SF_6$ is encapsulated inside a sealed space formed by the contact housing case 4, upper magnetic yoke 42, and cap 44.

Next, a description will be given of an operation of the first embodiment.

Herein, it is assumed that the fixed contacts 10Ab and 10Bb of the main contact mechanisms 9A and 9B are connected via an external connection terminal (not shown) to, for example, a power supply source that supplies a large current, while the fixed contacts 10Aa and 10Ba are connected via an external connection terminal (not shown) to a load.

In this state, the exciting coil 43 in the electromagnet unit 3 is in a non-exciting state, and there exists a released state wherein no exciting force causing the movable plunger 45 to move is being generated in the electromagnet unit 3.

In this released state, the movable plunger 45 is urged in a downward direction away from the upper magnetic yoke 42 by the return spring 47, and contacts a bottom portion of the cap 44, as shown in FIG. 2 and FIG. 5. Because of this, the movable contacts 14A and 14B of the main contact mechanisms 9A and 9B coupled to the movable plunger 45 via the coupling shaft 17 face the fixed contacts 10Aa, 10Ab and 10Ba, 10Bb from below across a predetermined gap. Because of this, there exists an opened contact state wherein the fixed contacts 10Aa and 10Ab, and the fixed contacts 10Ba and 10Bb, are electrically cut off.

On energizing the exciting coil 43 of the electromagnet unit 3 in the released state of the main contact mechanisms 9A and 9B, an exciting force is generated in the electromagnet unit 3, and the movable plunger 45 is pressed upward against the return spring 47. In response to this, the movable contact holding portion 15 coupled via the coupling shaft 17 to the movable plunger 45 moves upward. Because of this, the movable contacts 14A and 14B of the main contact mechanisms 9A and 9B held by the movable contact holding portion 15 move upward. Consequently, the movable contacts 14A and 14B contact the lower surfaces of the fixed contacts 10Aa, 10Ab and 10Ba, 10Bb with the contact pressure of the contact spring 20.

Because of this, the main contact mechanism 9A changes to an engaged state wherein a large current i of the external power supply source is supplied to the load via an external connection terminal (not shown), the fixed contact 10Ab, the movable contact 14A, the fixed contact 10Aa, and an external connection terminal (not shown).

In the same way, the main contact mechanism 9B also changes to an engaged state wherein the large current i of the external power supply source is supplied to the load via an external connection terminal (not shown), the fixed contact 10Bb, the movable contact 14B, the fixed contact 10Ba, and an external connection terminal (not shown).

When interrupting the supply of current to the load in the engaged state of the main contact mechanisms 9A and 9B, the energizing of the exciting coil 43 of the electromagnet unit 3 is stopped.

Because of this, there is no longer an exciting force in the electromagnet unit 3 moving the movable plunger 45 upward. Therefore, the movable plunger 45 descends due to the urging force of the return spring 47. By the movable plunger 45 descending, the movable contact holding portion 15 coupled via the coupling shaft 17 descends, in accordance with which the movable contacts 14A and 14B descend.

At this time, the movable contacts 14A and 14B are contacting the fixed contacts 10Aa, 10Ab and 10Ba, 10Bb until there is no longer any contact pressure from the contact spring 20. Subsequently, an opened contact state wherein the movable contacts 14A and 14B separate downward from the fixed contacts 10Aa, 10Ab and 10Ba, 10Bb is created at the point at which there ceases to be contact pressure from the contact spring 20.

On the opened contact state being created, an arc is generated between the fixed contacts 10Aa, 10Ab and 10Ba, 10Bb and the movable contacts 14A and 14B. The arc generated is extended by the magnetic force of an unshown arc extinguishing permanent magnet, and extinguished.

In this way, according to the first embodiment, it is possible for the two main contact mechanisms 9A and 9B disposed in parallel to be simultaneously put into a released state or engaged state by the movable contact holding portion 15 being moved up and down via the coupling shaft 17 by the same movable plunger 45 of the electromagnet unit 3.

At this time, the movable contacts 14A and 14B of the two main contact mechanisms 9A and 9B are held by the same movable contact holding portion 15, because of which mirror contact, wherein the movable contacts 14A and 14B and the fixed contacts 10Aa, 10Ab and 10Ba, 10Bb are simultaneously in a state of contact, becomes possible. In particular, by the contact spring 20 being disposed on the movable contact holding portion 15 side, it is possible to obtain more accurate mirror contact compared with when providing a contact spring for each of the movable contacts 14A and 14B individually.

Moreover, as the two main contact mechanisms 9A and 9B are moved by the same electromagnet unit 3, it is possible to reduce the size of the overall configuration compared with when providing two electromagnetic contactors.

Further, the two main contact mechanisms 9A and 9B are housed inside the same contact housing case 4. Moreover, the main contact mechanisms 9A and 9B are such that the arc generating contact portions of the fixed contacts 10Aa, 10Ab and 10Ba, 10Bb and the movable contacts 14A and 14B are separated by the isolating partition portion 7. Because of this, the arcs are reliably prevented from interfering with each other, and it is possible to reliably carry out arc extinguishing.

In the first embodiment, a description has been given of case wherein the fixed contacts 10Ab and 10Bb are connected to a power supply source and the fixed contacts 10Aa and 10Ba are connected to a load, but not being limited to this, the fixed contacts 10Aa and 10Ba may be connected to the power supply source and the fixed contacts 10Ab and 10Bb connected to the load. Furthermore, one of the fixed contacts 10Aa and 10Ba, for example the fixed contact 10Aa, may be connected to the power supply source and the other fixed contact 10Ba connected to the load, while one of the fixed contacts 10Ab and 10Bb, the fixed contact 10Ab, is connected to the load and the other fixed contact 10Bb is connected to the power supply source.

Also, in the first embodiment, a description has been given of a case wherein the fixed contacts 10Aa, 10Ab and 10Ba, 10Bb are caused to oppose on the upper side of the movable contacts 14A and 14B but, not being limited to this, the fixed contacts 10Aa, 10Ab and 10Ba, 10Bb may face the lower side of the movable contacts 14A and 14B.

Furthermore, in the first embodiment, a description has been given of a case wherein two main contact mechanisms are formed in parallel but, not being limited to this, three or more main contact mechanisms may be formed in parallel.

Next, based on FIG. 6 to FIG. 12(*b*), a description will be given of a second embodiment of the invention.

In the second embodiment, one of the two main contact mechanisms is omitted, auxiliary contact mechanisms are disposed in place of the omitted main contact mechanism, and the main contact mechanism and auxiliary contact mechanisms are driven simultaneously.

That is, in the second embodiment, the main contact mechanism 9A of the first embodiment is left as it is, and two auxiliary contact mechanisms 51A and 51B are provided in place of the main contact mechanism 9B, as shown in FIG. 6 to FIG. 12(*b*).

The two auxiliary contact mechanisms 51A and 51B are disposed with front-back line symmetry sandwiching the movable contact holding portion 15. Further, fixed contact holding portions 52A and 52B formed of isolating bodies are disposed on front and back inner walls in the contact housing chamber 8B.

Figure 12A:
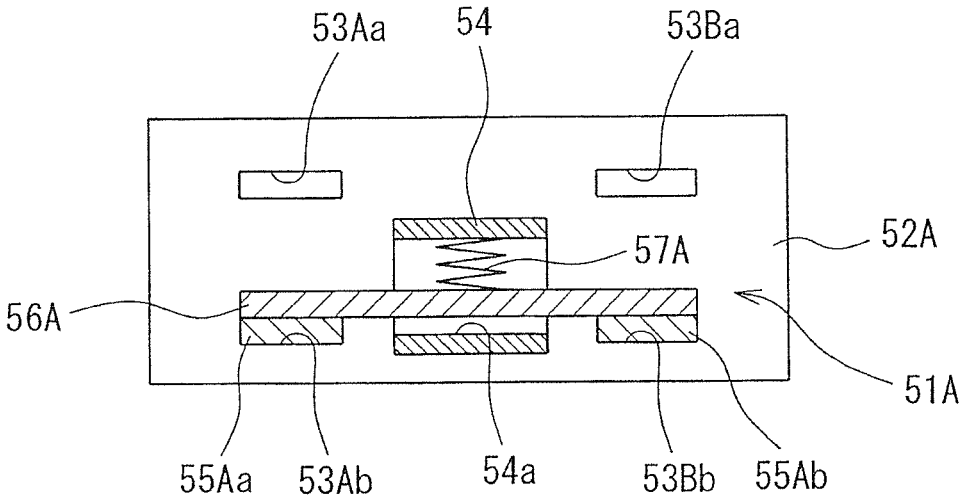
FIGS. 12(*a*) and 12(*b*) are sectional views showing auxiliary contacts of FIG. 11, wherein FIG. 12(*a*) is a sectional view along the line F-F of FIG. 11 and FIG. 12(*b*) is a sectional view along the line G-G of FIG. 11.
Figure 12B:
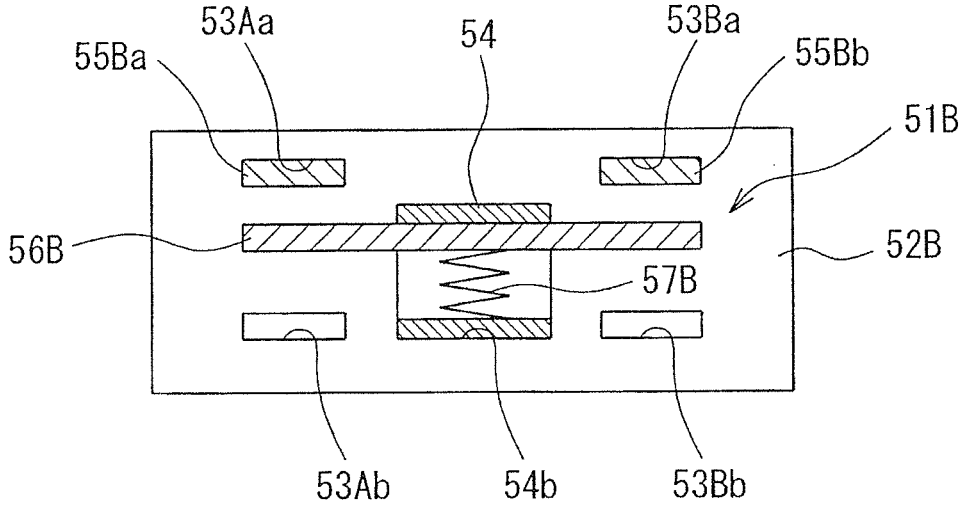

The fixed contact holding portions 52A and 52B are such that four fixed contact holding holes 53Aa, 53Ab and 53Ba, 53Bb are formed maintaining predetermined distances in a horizontal direction and vertical direction on opposing surfaces of the two, as shown in FIGS. 12(*a*) and 12(*b*).

Each of the fixed contact holding holes 53Aa, 53Ab and 53Ba, 53Bb is formed as a flattened rectangle whose sectional form extends in a horizontal direction.

Figure 8:
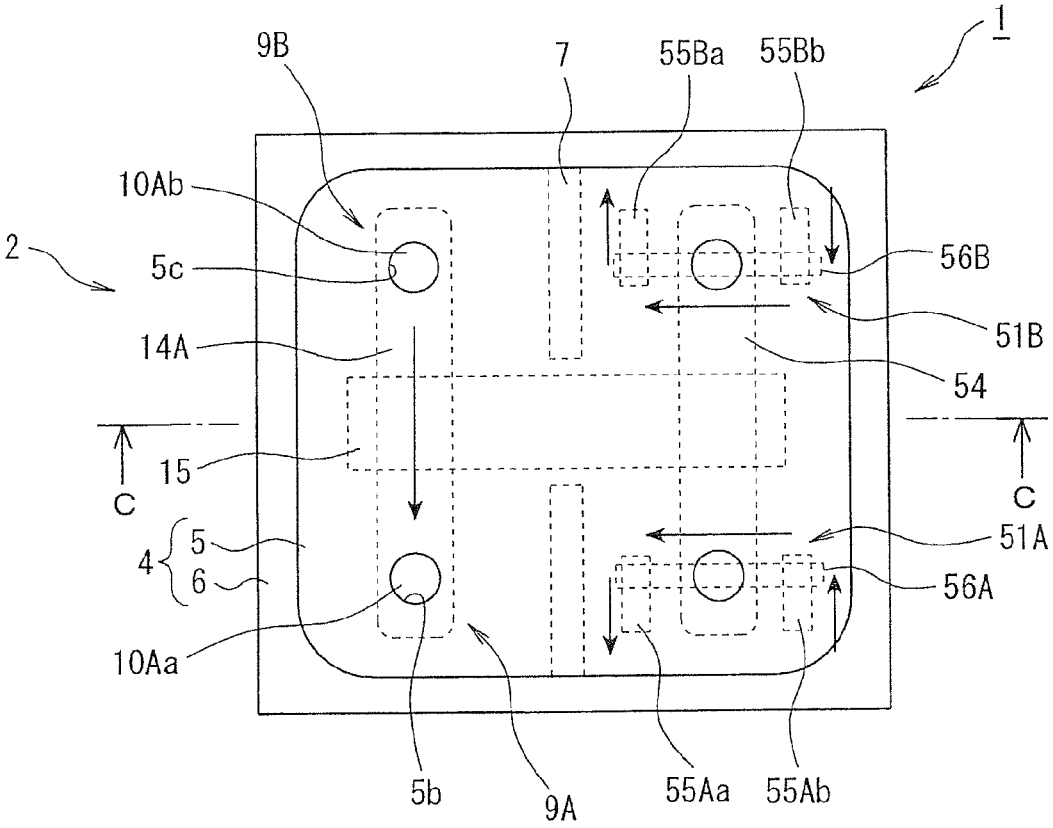
FIG. 8 is a plan view of FIG. 6.
Figure 9:
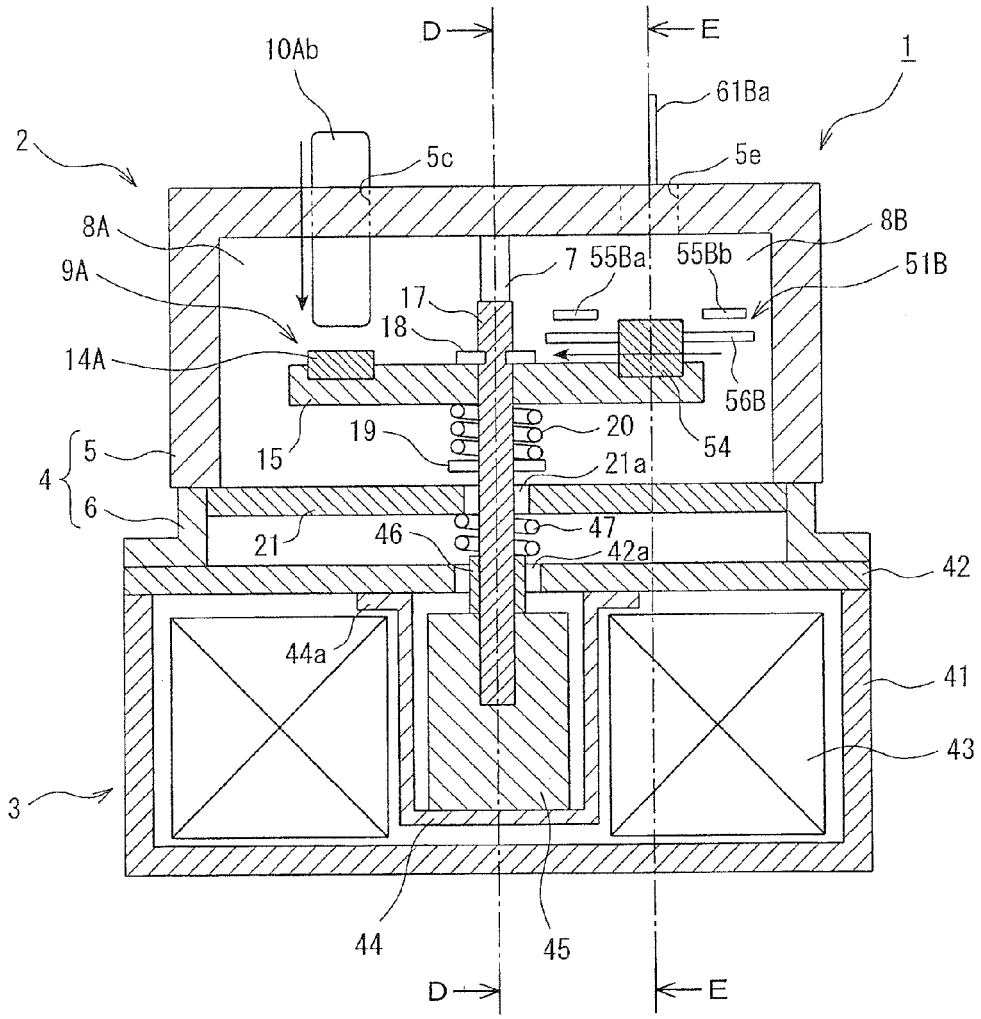
FIG. 9 is a sectional view along the line C-C of FIG. 8.
Figure 10:
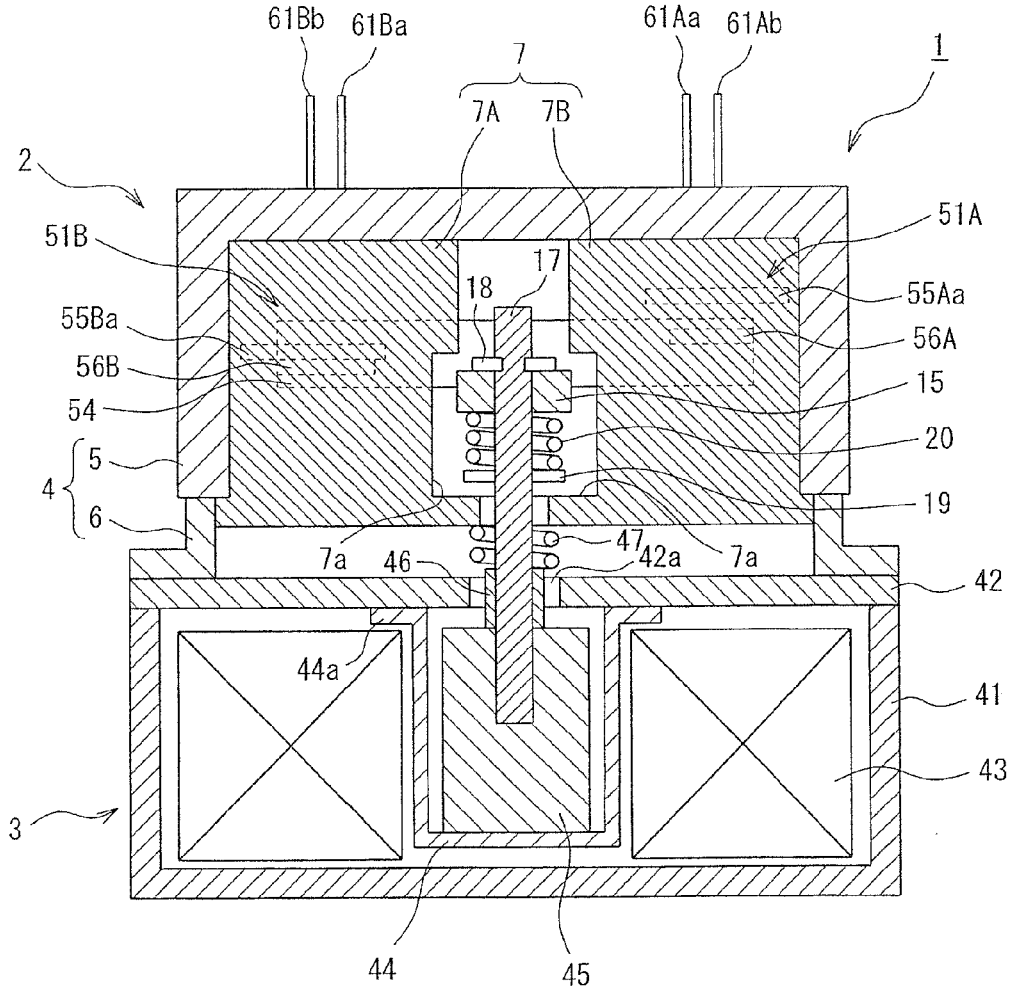
FIG. 10 is a sectional view along the D-D of FIG. 9.
Figure 11:
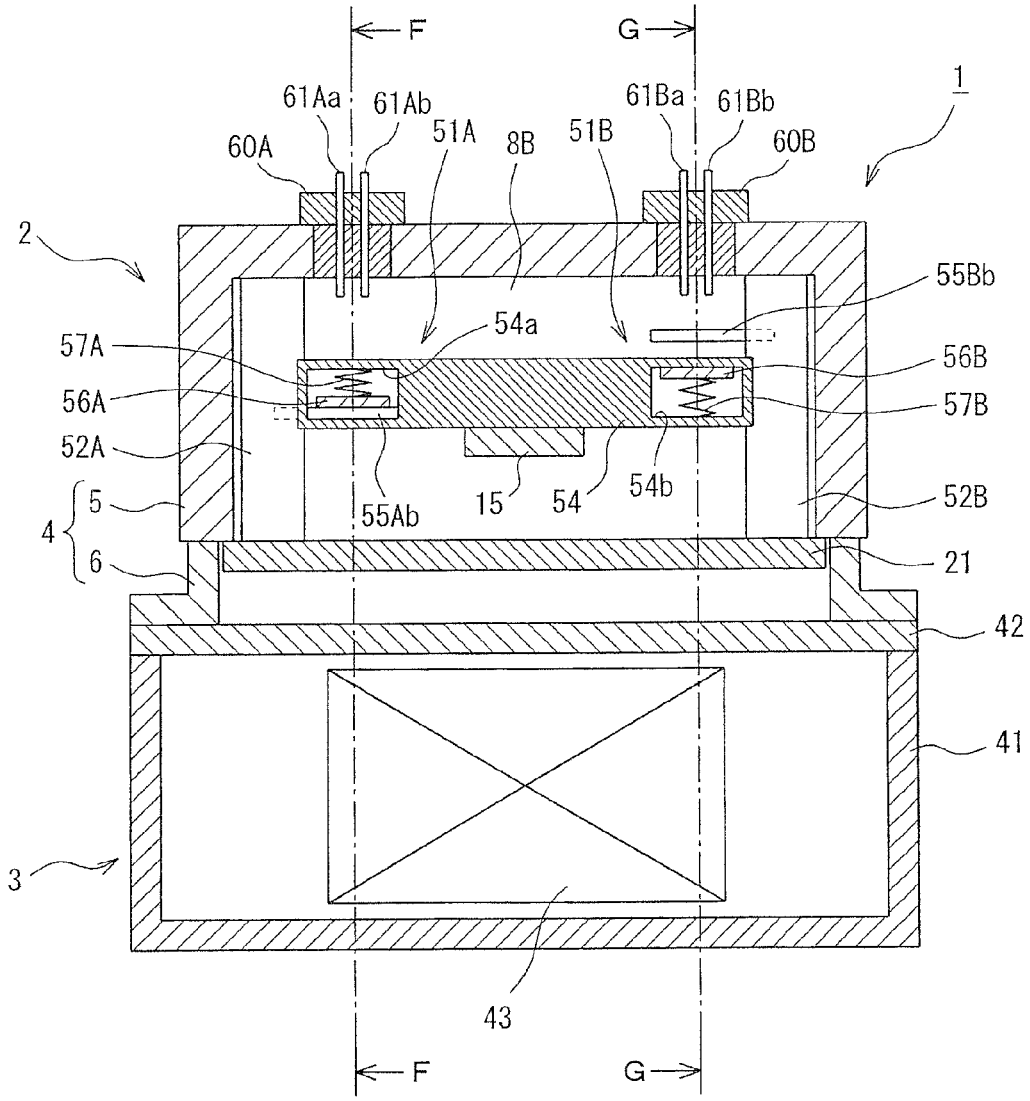
FIG. 11 is a sectional view along the line E-E of FIG. 9.

Also, an auxiliary movable contact holding portion 54 extending in a front-back direction is fitted onto and fixed to both horizontal direction end sides of the movable contact holding portion 15, as shown in FIG. 8 and FIG. 11. Movable contact holding holes 54*a* and 54*b* penetrating in a horizontal direction are formed one in either front and back end portion side in the auxiliary movable contact holding portion 54, as shown in FIG. 11 and FIGS. 12(*a*) and 12(*b*).

Further, the auxiliary contact mechanism 51A is such that fixed contacts 55Aa and 55Ab are held in the fixed contact holding holes 53Ab and 53Bb of the fixed contact holding portion 52A, as shown in FIG. 8, FIG. 11, and FIG. 12(*a*).

Also, a movable contact 56A and contact spring 57A are held in the movable contact holding hole 54*a* of the auxiliary movable contact holding portion 54, with the movable contact 56A on the lower side, so that the movable contact 56A is pressed downward by the contact spring 57A.

Because of this, with the electromagnet unit 3 in a non-exciting state, the auxiliary contact mechanism 51A is of a b contact configuration wherein the movable contact 56A is contacting the fixed contacts 55Aa and 55Ab with the contact pressure of the contact spring 57A, as shown in FIG. 12(*a*). Further, although not shown, the fixed contacts 55Aa and 55Ab are connected via a conductor to terminals 61Aa and 61Ab of an auxiliary contact inlet terminal portion 60A disposed in the tub-form body 5.

Meanwhile, the auxiliary contact mechanism 51A is such that fixed contacts 55Ba and 55Bb are held in the fixed contact holding holes 53Aa and 53Ba of the fixed contact holding portion 52B, as shown in FIG. 8, FIG. 11, and FIG. 12(*b*). Also, a movable contact 56B and contact spring 57B are held in the movable contact holding hole 54*b* of the auxiliary movable contact holding portion 54, with the contact spring 57B on the lower side, so that the movable contact 56B is pressed upward by the contact spring 57B.

Because of this, with the electromagnet unit 3 in a non-exciting state, the auxiliary contact mechanism 51B forms an a contact configuration wherein the movable contact 56B is separated by a predetermined distance from the fixed contacts 55Ba and 55Bb, as shown in FIG. 12(*b*). Further, although not shown, the fixed contacts 55Ba and 55Bb are connected via a conductor to terminals 61Ba and 61Bb of an auxiliary contact inlet terminal portion 60B disposed in the tub-form body 5.

Next, a description will be given of an operation of the second embodiment.

Regarding the main contact mechanism 9A, when the exciting coil 43 in the electromagnet unit 3 is in a non-exciting state, there exists a released state maintaining an opened contact state wherein the movable contact 14A is separated downward from the fixed contacts 10Aa and 10Ab, in the same way as in the first embodiment. Also, when the exciting coil 43 in the electromagnet unit 3 is in a conductive state, there exists an engaged state wherein the movable contact 14A is contacting the fixed contacts 10Aa and 10Ab with the contact pressure of the contact spring 20, maintaining a closed contact state.

As opposed to this, in a state wherein the exciting coil 43 in the electromagnet unit 3 is in a non-conductive state and the movable plunger 45 contacts a bottom portion of the cap 44 by the return spring 47, the first auxiliary contact mechanism 51A is of a closed contact state wherein the movable contact 56A is contacting the fixed contacts 55Aa and 55Ab with the contact pressure of the contact spring 57A, as shown in FIG. 12(*a*). Because of this, by connecting the terminal 61Ab of the auxiliary contact inlet terminal position 60A to the power supply and connecting the terminal 61Aa to the load, current flows from the terminal 61Ab through the fixed contact 55Ab, movable contact 56A, and fixed contact 55Aa to the terminal 61Aa.

By the exciting coil 43 of the electromagnet unit 3 being energized in the closed contact state, the movable plunger 45 moves upward against the return spring 47, upon which the movable contact holding portion 15 moves upward. By the auxiliary movable contact holding portion 54 moving upward in accordance with the movement of the movable contact holding portion 15, the movable contact 56A is separated upward from the fixed contacts 55Aa and 55Ab, and the current flowing between the two is interrupted, creating an opened contact condition.

As opposed to this, in a state wherein the exciting coil 43 of the electromagnet unit 3 is in a non-conductive state and the movable plunger 45 contacts the bottom surface of the cap 44 by the return spring 47, in the second auxiliary contact mechanism 51B, the movable contact 56B is separated downward from the fixed contacts 55Ba and 55Bb, as shown in FIG. 12(*b*), which is the opposite of the first auxiliary contact mechanism 51A. Because of this, when the terminal 61Ab of the auxiliary contact inlet terminal portion 60A is connected to the power supply and the terminal 61Aa is connected to the load, an opened contact state wherein the current between the terminals 61Ab and 61Aa is interrupted is maintained.

By the exciting coil 43 of the electromagnet unit 3 being energized in the opened contact state, the movable plunger 45 moves upward against the return spring 47, upon which the movable contact holding portion 15 moves upward. By the auxiliary movable contact holding portion 54 moving upward in accordance with the movement of the movable contact holding portion 15, the movable contact 56B contacts the fixed contacts 55Ba and 55Bb with the contact pressure of the contact spring 57B, and current flows from the terminal 61Bb through the fixed contact 55Bb, movable contact 56B, and fixed contact 55Ba to the terminal 61Ba, creating a closed contact state.

The heretofore described configuration is a description of a case of adopting a 1a1b contact configuration, wherein the first auxiliary contact mechanism 51A is of a b contact configuration and the second auxiliary contact mechanism 51B of an a contact configuration. It is also possible for the first auxiliary contact mechanism 51A to be of an a contact configuration and the second auxiliary contact mechanism 51B of a b contact configuration.

In order to do this, the fixed contacts 55Aa and 55Ab are held in the contact holding holes 53Aa and 53Ba instead of the contact holding holes 53Ab and 53Bb of the fixed contact holding portion 52A in the first auxiliary contact mechanism 51A. Also, the fixed contacts 55Ba and 55Bb are held in the contact holding holes 53Ab and 53Bb instead of the contact holding holes 53Aa and 53Ba of the fixed contact holding portion 52B in the second auxiliary contact mechanism 51B. Furthermore, the auxiliary movable contact holding portion 54 is fixed to the movable contact holding portion 15 with the front and back of the auxiliary movable contact holding portion 54 reversed, or the up-down relationship of the movable contacts 56A and 56B and contact springs 57A and 57B inside the contact holding holes 54*a* and 54*b* of the auxiliary movable contact holding portion 54 is reversed. By so doing, it is possible to adopt an a contact configuration for the first auxiliary contact mechanism 51A and adopt a b contact configuration for the second auxiliary contact mechanism 51B.

Furthermore, it is possible to adopt an a2 contact configuration by changing the first auxiliary contact mechanism 51A to an a contact configuration in the same way as that heretofore described, and conversely, it is possible to adopt a b2 contact configuration by changing the second auxiliary contact mechanism 51B to a b contact configuration in the same way as that heretofore described.

In this way, in the second embodiment, the main contact mechanism 9A and first and second auxiliary contact mechanisms 51A and 51B are disposed in parallel inside the contact housing case 4. Because of this, by controlling the energizing of the exciting coil 43 of the same electromagnet unit 3, it is possible to drive the main contact mechanism 9A in a released state and an engaged state, and it is possible to drive the first auxiliary contact mechanism 51A in a closed contact state and an opened contact state, and drive the second auxiliary contact mechanism 51B in an opened contact state and a closed contact state. Consequently, it is possible to simultaneously drive the main contact mechanism 9A and the 1a1b contact configuration auxiliary contact mechanisms 51A and 51B. Because of this, it is possible to reduce the size of the overall configuration compared with when providing the main contact mechanism 9A and auxiliary contact mechanisms 51A and 51B individually.

Moreover, the movable contact 14A of the main contact mechanism 9A and the movable contacts 56A and 56B of the first and second auxiliary contact mechanisms 51A and 51B are held by the same movable contact holding portion 15 and auxiliary movable contact holding portion 54. Because of this, the movable contacts 14A and 56A, 56B of each contact mechanism are simultaneously moved vertically, because of which it is possible to reliably obtain mirror contact of the movable contacts of the main contact mechanism 9A and auxiliary contact mechanism 51B.

Also, the first and second auxiliary contact mechanisms 51A and 51B have the fixed contact holding portions 52A and 52B, and the fixed contact holding portions 52A and 52B include the fixed contact holding holes 53Aa, 53Ab and 53Ba, 53Bb in which the fixed contacts 55Aa, 55Ab and 55Ba, 55Bb can be held, selecting from top and bottom. Because of this, the fixed contacts 55Aa, 55Ab and 55Ba, 55Bb can be selectively mounted top or bottom.

Simultaneously with this, by selecting the up-down relationship of the movable contacts 56A and 56B and contact springs 57A and 57B in the contact holding holes 54*a* and 54*b* of the auxiliary movable contact holding portion 54, it is possible to arbitrarily set the first and second auxiliary contact mechanisms 51A and 51B to either an a contact configuration or b contact configuration, and thus possible to select the contact configuration in accordance with the demands of the consumer. Consequently, it is possible to arbitrarily select an a2 contact configuration, a b2 contact configuration, or a 1a1b contact configuration using the same configuration, without configuring a separate auxiliary contact mechanism, and thus possible to increase the freedom of the auxiliary contact mechanism contact configuration.

In the second embodiment, a description has been given of a case wherein the main contact mechanism 9A of the first embodiment is left as it is, but it is also possible to leave the main contact mechanism 9B as it is, and apply the first auxiliary contact mechanism 51A and second auxiliary contact mechanism 51B instead of the main contact mechanism 9A.

Also, in the second embodiment, a description has been given of a case wherein the main contact mechanism and first and second auxiliary contact mechanisms are disposed in parallel but, not being limited to this, it is also possible to provide a set of two main contact mechanisms sandwiching first and second auxiliary contact mechanisms, and conversely, it is also possible to dispose a set of two first and second auxiliary contact mechanisms on either side of a main contact mechanism.

Also, in the first and second embodiments, a description has been given of a case wherein the contact housing case 4 is configured of the ceramic tub-form body 5 and the joining member 6 but, not being limited to this, the contact housing case 4 can also be configured of a metal tubular body, on the inner peripheral surface of which is disposed a cylindrical body made of an insulating material, and a ceramic cover plate portion that closes off the upper surface of the metal tubular body.

Furthermore, in the first and second embodiments, a description has been given of a case wherein a sealed space is formed by the contact housing case 4, upper magnetic yoke 42, and cap 44, and an arc extinguishing gas is encapsulated in the sealed space. However, the invention not being limited to the above-described configuration, the encapsulation of the arc extinguishing gas can be omitted when the value of the current energizing the main contact mechanisms 9A and 9B is low. In this case, the cap 44 can also be omitted.

Furthermore, in the first and second embodiments, a description has been given of a case wherein the invention is applied to an electromagnetic contactor but, not being limited to this, the invention is also applicable to any electromagnetic switch including an electromagnetic relay or other instrument that electromagnetically carries out a switching operation.

INDUSTRIAL APPLICABILITY

According to the invention, it is possible to provide an electromagnetic switch such that a plurality of contact mechanisms is disposed in parallel, there is considerable freedom of contact configuration, and it is possible to reliably obtain mirror contact of each of the plurality of contact mechanisms.

REFERENCE SIGNS LIST

1 . . . Electromagnetic switch, . . . Contact device, 3 . . . Electromagnet unit, 4 . . . Contact housing case, 5 . . . Tub-form body, 6 . . . Joining member, 7 . . . Isolating partition portion, 9A, 9B . . . Main contact mechanism, 10Aa, 10Ab, 10Ba, 10Bb . . . Fixed contact, 14A, 14B . . . Movable contact, 15 . . . Movable contact holding portion, 17 . . . Coupling shaft, 20 . . . Contact spring, 41 . . . Magnetic yoke, 42 . . . Upper magnetic yoke, 43 . . . Exciting coil, 44 . . . Cap, 45 . . . Movable plunger, 47 . . . Return spring, 51A . . . First auxiliary contact mechanism, 51B . . . Second auxiliary contact mechanism, 52A, 52B . . . Fixed contact holding portion, 53Aa, 53Ab, 53Ba, 53Bb . . . Fixed contact holding hole, 54*a*, 54*b* . . . Movable contact holding hole, 55Aa, 55Ab, 55Ba, 55Bb . . . Fixed contact, 56A, 56B . . . Movable contact, 57A, 57B . . . Contact spring, 60A, 60B . . . Auxiliary contact inlet terminal portion

What is claimed is:

1. An electromagnetic switch comprising:

a contact housing case;

a main contact mechanism disposed inside the contact housing case, and including a pair of fixed contacts spaced apart from each other, and a movable contact disposed contacting to and separating from the fixed contacts;

two auxiliary contact mechanisms disposed inside the contact housing case, each including a pair of auxiliary fixed contacts spaced apart from each other and an auxiliary movable contact disposed contacting to and separating from the auxiliary fixed contacts, a movable contact holding portion holding the movable contact of the main contact mechanism;

an auxiliary movable contact holding portion fixed to the movable contact holding portion and holding the auxiliary movable contacts; and an electromagnet unit having a movable plunger moving the movable contact holding portion, wherein the movable contact is disposed at one side of the movable contact holding portion, and the auxiliary movable contact holding portion is disposed at another side of the movable contact holding portion opposite to the one side of the movable contact holding portion in respect to the movable plunger, and one of the auxiliary movable contacts of the two auxiliary contact mechanisms is disposed at one side of the auxiliary movable contact holding portion, and the other of the auxiliary movable contacts is disposed at another side of the auxiliary movable contact holding portion opposite to the one side of the auxiliary movable contact holding portion in respect to the movable contact holding portion.

2. The electromagnetic switch according to claim 1, wherein the contact housing case has an isolating partition portion partitioning a housing section housing the contact mechanisms.

3. The electromagnetic switch according to claim 1, wherein the two auxiliary contact mechanisms are arranged line symmetrically relative to the movable contact holding portion.

4. The electromagnetic switch according to claim 1, wherein each of the two auxiliary contact mechanisms includes an auxiliary fixed contact holding portion holding the auxiliary fixed contacts of the auxiliary contact mechanism, and the auxiliary movable contact holding portion includes contact holding holes each holding the one or the other of auxiliary movable contacts of the auxiliary contact mechanisms by a contact spring.

5. The electromagnetic switch according to claim 1, wherein the movable contact and the auxiliary movable contact holding portion are arranged parallel to each other, and the two auxiliary movable contacts are perpendicular to the auxiliary movable contact holding portion and arranged parallel to each other.

6. The electromagnetic switch according to claim 5, wherein the contact housing case has an isolating partition portion partitioning between the two auxiliary contact mechanisms and the main contact mechanism so that the two auxiliary contact mechanisms and the main contact mechanism are opposite to each other in respect to the isolating partition portion.

7. The electromagnetic switch according to claim 6, wherein the auxiliary movable contact holding portion includes:

a first auxiliary movable contact holding hole at the one side of the auxiliary movable contact holding portion to hold the one of the auxiliary movable contacts therein, and having a first contact spring disposed inside the first auxiliary movable contact holding hole to urge the one of the auxiliary movable contacts in a first direction to contact to or separate from the corresponding pair of auxiliary fixed contacts of the one of the auxiliary movable contacts, and a second auxiliary movable contact holding hole at the another side of the auxiliary movable contact holding portion to hold the other of the auxiliary movable contacts therein, and having a second contact spring disposed inside the second auxiliary movable contact holding hole to urge the other of the auxiliary movable contacts in a second direction opposite to the first direction to separate from or contact to the corresponding pair of auxiliary fixed contacts of the other of the auxiliary movable contacts.

* * * * *